US011415137B2

(12) United States Patent
Afshar

(10) Patent No.: US 11,415,137 B2
(45) Date of Patent: Aug. 16, 2022

(54) SWIMMING POOL PUMP WITH AN INLET DEFLECTOR AND VARIABLE SIZE IMPELLER

(71) Applicant: Reza Afshar, Newbury Park, CA (US)

(72) Inventor: Reza Afshar, Newbury Park, CA (US)

( * ) Notice: Subject to any disclaimer, the term of this patent is extended or adjusted under 35 U.S.C. 154(b) by 0 days.

(21) Appl. No.: 15/910,023

(22) Filed: Mar. 2, 2018

(65) Prior Publication Data

US 2019/0271320 A1 Sep. 5, 2019

(51) Int. Cl.

| | |
|---|---|
| ***F04D 9/00*** | (2006.01) |
| ***E04H 4/12*** | (2006.01) |
| ***F04D 29/08*** | (2006.01) |
| ***F04D 29/42*** | (2006.01) |
| ***F04D 29/70*** | (2006.01) |
| *F04D 1/00* | (2006.01) |

(52) U.S. Cl.

CPC ..... *F04D 9/008* (2013.01); *E04H 4/12* (2013.01); *F04D 29/086* (2013.01); *F04D 29/426* (2013.01); *F04D 29/708* (2013.01); *F04D 1/00* (2013.01)

(58) Field of Classification Search

CPC ..... F04D 9/008; F04D 13/06; F04D 29/086; F04D 29/426; F04D 29/4206; F04D 29/44; F04D 29/708; E04H 4/12

See application file for complete search history.

(56) References Cited

U.S. PATENT DOCUMENTS

| | | | | |
|---|---|---|---|---|
| 3,252,575 | A * | 5/1966 | Jacuzzi | B01D 35/26 210/136 |
| 4,737,279 | A * | 4/1988 | Lewis | E04H 4/1272 210/167.1 |
| 8,820,355 | B2 * | 9/2014 | Sutton | E04H 4/1272 137/625.11 |
| 8,944,787 | B2 * | 2/2015 | Korupp | B01D 29/96 417/423.14 |
| 9,945,139 | B2 * | 4/2018 | Norberto, III | E04H 4/1263 |
| 2007/0163933 | A1 * | 7/2007 | Goggin | E04H 4/1272 210/167.1 |
| 2013/0146525 | A1 * | 6/2013 | Parcell | B01D 29/35 210/348 |

* cited by examiner

*Primary Examiner* — Brian P Wolcott
*Assistant Examiner* — Sang K Kim
(74) *Attorney, Agent, or Firm* — Louis F. Teran

(57) ABSTRACT

Centrifugal pumps are widely used in swimming pools as part of the recirculation system that sucks water from the swimming pool through the drain and them pumps it back into the pool after filtration. The present invention relates to a centrifugal pump for swimming pools that can accommodate impellers of varying size to attain the proper flow rate for varying circumstances. The centrifugal pump of the present invention also includes a deflector that improves the priming of the pump so as to eliminate or reduce the risk of heat and friction damage to the impeller.

11 Claims, 5 Drawing Sheets

SWIMMING POOL PUMP WITH AN INLET DEFLECTOR AND VARIABLE SIZE IMPELLER

FIELD OF INVENTION

The present invention relates to a centrifugal pump that is used in a swimming pool as part of its recirculation system that sucks water from the pool through the drain and then pumps it back into the pool after filtration. In particular, the present invention relates to a centrifugal pump used in swimming pools that can accommodate impellers of varying size to attain the proper flow rate for varying circumstances and that has an inlet deflector that significantly improves the priming of the pump so as to eliminate or reduce the risk of heat and friction damage to the impeller.

DESCRIPTION OF PRIOR ART

A swimming pool or simply a pool is a container filled with water intended for swimming or water-based recreation. A swimming pool can be built of various sizes and either above or in the ground. A swimming pool may be for public or private use. Private swimming pools are mostly built in residences and used for recreation and relaxation by adults, children, and even infants. Public pools are mostly built in hotels, schools, fitness centers, and parks. Public pools are mostly used for fitness, water sports, and training by people of all ages, including elderly and young children.

Swimming pools are designed to be large containers of water with a drain, inlet connection, and a water recirculation system. The water recirculation system is driven by a large centrifugal pump that extracts water from the pool through the drain. The water that is extracted from the pool is passed through a debris collection trap and a skimmer to remove large debris such as leaves and branches. The water is then pumped into a large filter to remove other contaminants. Finally, the centrifugal pump pumps the filtered water back into the swimming pool through the inlet connections that are typically located around the interior wall of the pool.

The recirculation system of a swimming pool is pressurized so that the centrifugal pump can suck the water from the swimming pool through the drain and then pump the filtered water back into the swimming pool through the inlet connections. The pressurized recirculation system allows the water to maintain a constant flow that circulates the water through the filter.

Therefore, the centrifugal pumps used in swimming pools tend to be simple with a single inlet port through which water is sucked from the swimming pool and a single outlet port through which the water is pumped back into the swimming pool. The centrifugal pump used in swimming pools typically have a strainer housing to which the inlet port is attached and into which a strainer is placed. As the water is sucked from the swimming pool, the water flows into the strainer housing where the strainer removes large debris that were not removed by the skimmer or filter of the swimming pool. From the strainer housing, the water flows into the impeller shell through a diffuser. An impeller in the impeller shell is constantly spinning when the centrifugal pump is turned on or activated. The rotational forces exerted by the rotating impeller pumps the water out through the outlet port that is connected to the impeller shell. Then the water is pushed back into the swimming pool.

A disadvantage of current centrifugal pumps used in swimming pools or the prior art, is that the pumps can only accommodate limited sizes of impellers due to space constraint, and limitations on efficiency and performance. Under certain circumstances, a different size impeller is needed to pump the water at an improved flow rate, with improved head, or with higher flow requirements. Another disadvantage of the prior art is that the strainer used is circular in shape and has to be carefully inserted into the strainer housing in the proper alignment or direction so as not to interfere with the flow of water within the pump. Alignment of the strainer is typically done by aligning some markings and inspecting for proper alignment. Yet another disadvantage of the prior art is that when the centrifugal pump is turned off or deactivated, the water within the pump drops to the lowermost point of the inlet port. Any water above the lowermost point of the inlet port naturally flows out of the pump through the inlet port since the pump is turned off and the force that would typically suck water through the inlet port is terminated. Furthermore, the lowermost point of the inlet port is below the topmost point of the impeller of the pump. Thus, when the centrifugal pump is tuned back on or activated, the initial start-up of the pump is under conditions where the impeller is only partially submerged in water. Until the impeller shell is completely refilled with water after start-up, the impeller is forced to spin only partially submerged in water. Such condition can lead to heat and friction damage to the impeller.

SUMMARY OF THE INVENTION

Accordingly, the present invention has been made in view of the above-mentioned disadvantages occurring in the prior art. The present invention is a swimming pool pump that is capable of pumping water at a greater flow rate than the prior art and is primed quicker and more effectively than the prior art.

It is therefore a primary object of the present invention to incorporate an impeller shell that is expandable so as to accommodate impellers of varying sizes. Expanding the impeller shell to accommodate wider impeller allows the swimming pump of the present invention to pump water out to the swimming pool at a higher flow rate.

Another object of the present invention is to incorporate a deflector with an additional cavity within the strainer housing and immediately after the inlet port so as to deflect the water flow into the pump and reduce its turbulence.

Yet another object of the present invention is to extend the topmost point of said deflector to be at or near the topmost point of the impeller so that the water level within the pump when the pump is turned off or inactive is at or near the topmost point of the impeller. Allowing a substantial portion of the impeller to be submerged in water at the start-up of the pump substantially improves priming of the pump and reduces any heat and friction damage.

A final object of the present invention is to incorporate a strainer that is not completely round as in the prior art, rather the strainer of the present invention has a shape that corresponds to the deflector within the strainer housing. Such shape ensures that the strainer can only be placed inside the strainer housing in the proper alignment and direction.

The above objects and other features and advantages of the present invention, as well as the structure and operation of various embodiments of the present invention, are described in detail below with reference to the accompanying drawings.

DESCRIPTION OF THE DRAWINGS

The accompanying drawings which are incorporated by reference herein and form part of the specification, illustrate various embodiments of the present invention and, together with the description, further serve to explain the principles of the invention and to enable a person skilled in the pertinent art to make and use the invention. In the drawings, like reference numbers indicate identical or functional similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Reference will now be made to the drawings in which various elements of the present invention will be given numerical designations and in which the invention will be discussed so as to enable one skilled in the art to make and use the present invention.

Figure 1:
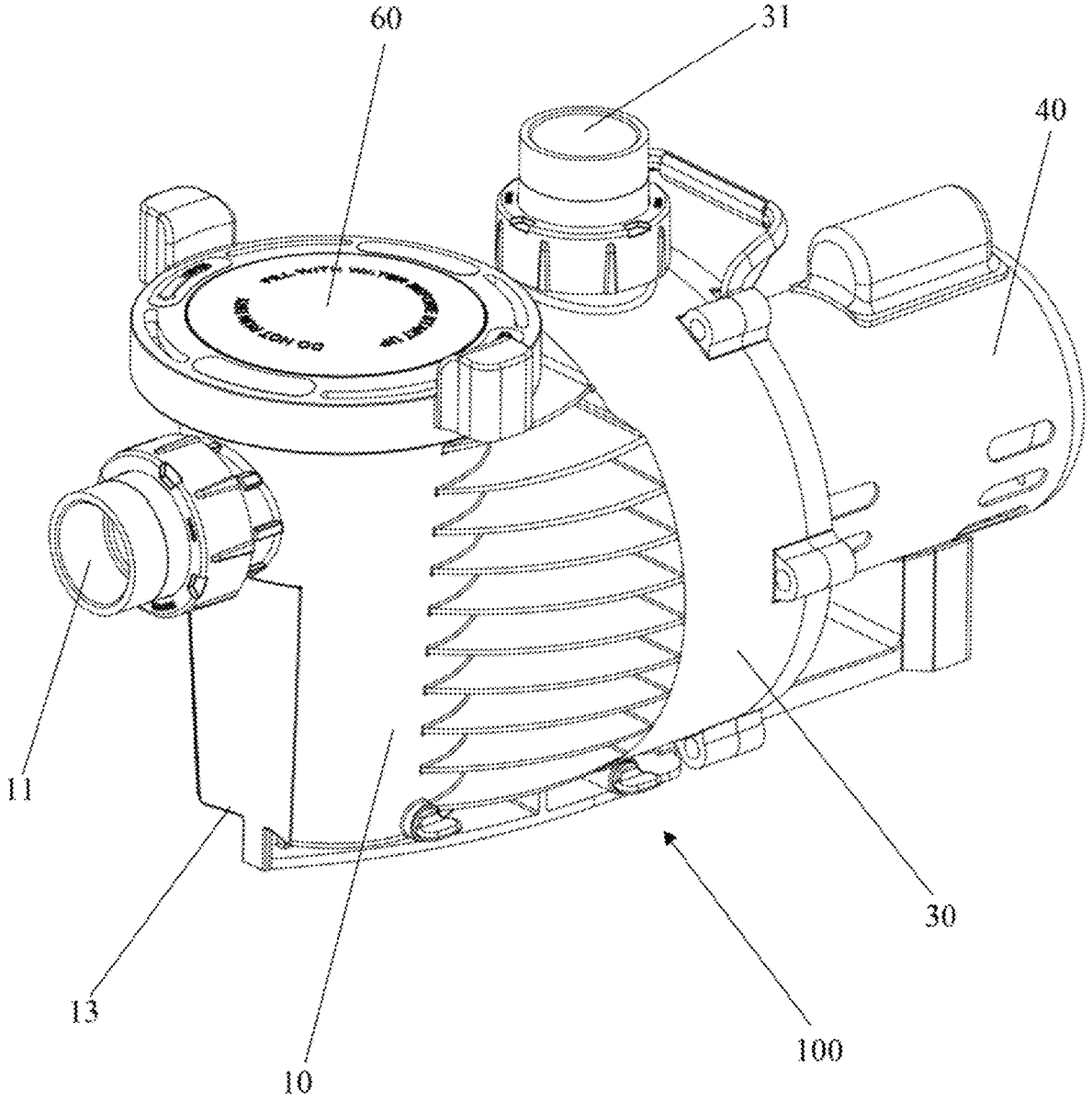
FIG. 1 is a perspective view of the swimming pool pump of the present invention in its assembled state as it would be installed.
Figure 2:
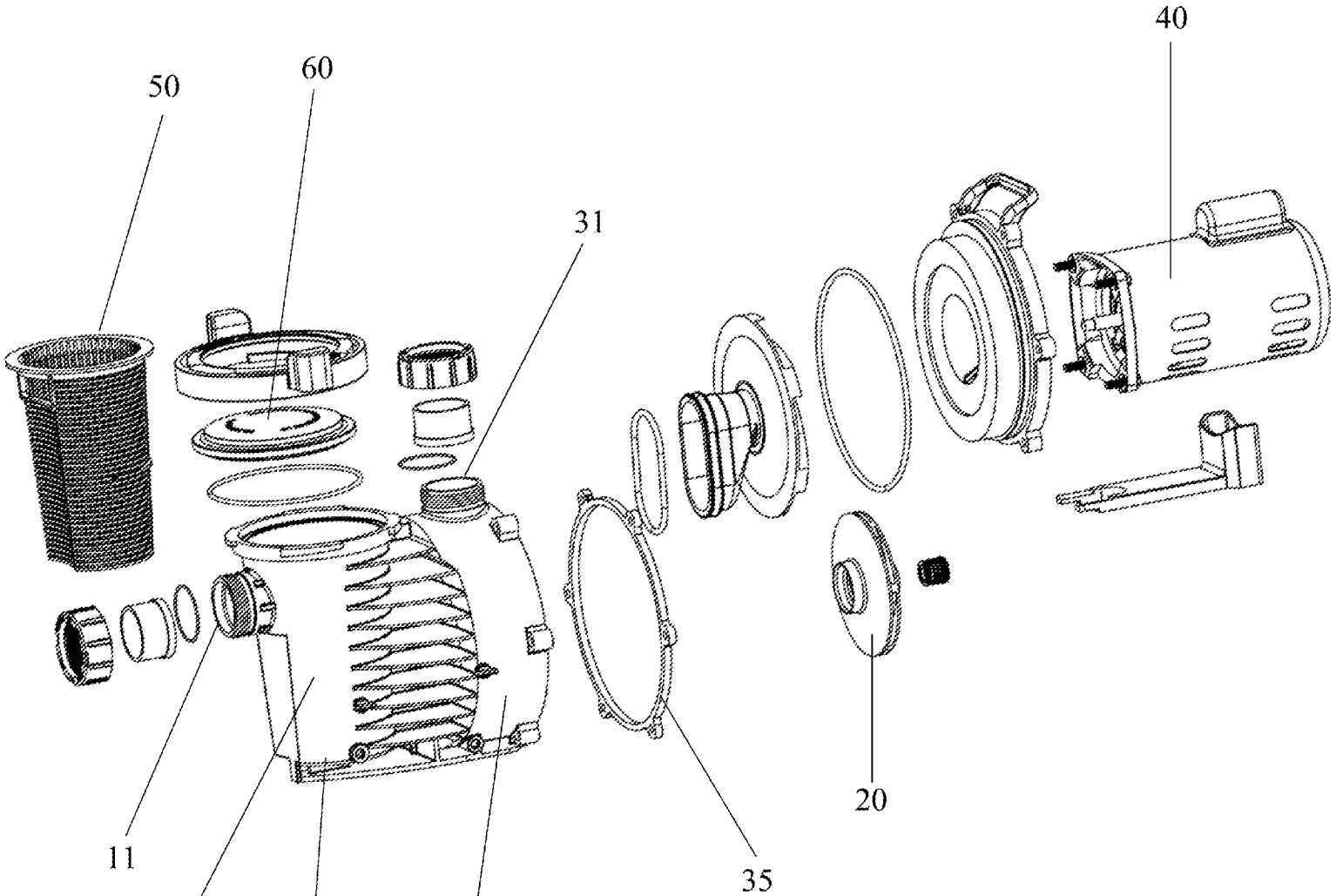
FIG. 2 is an exploded view of the swimming pool pump of the present invention.
Figure 3:
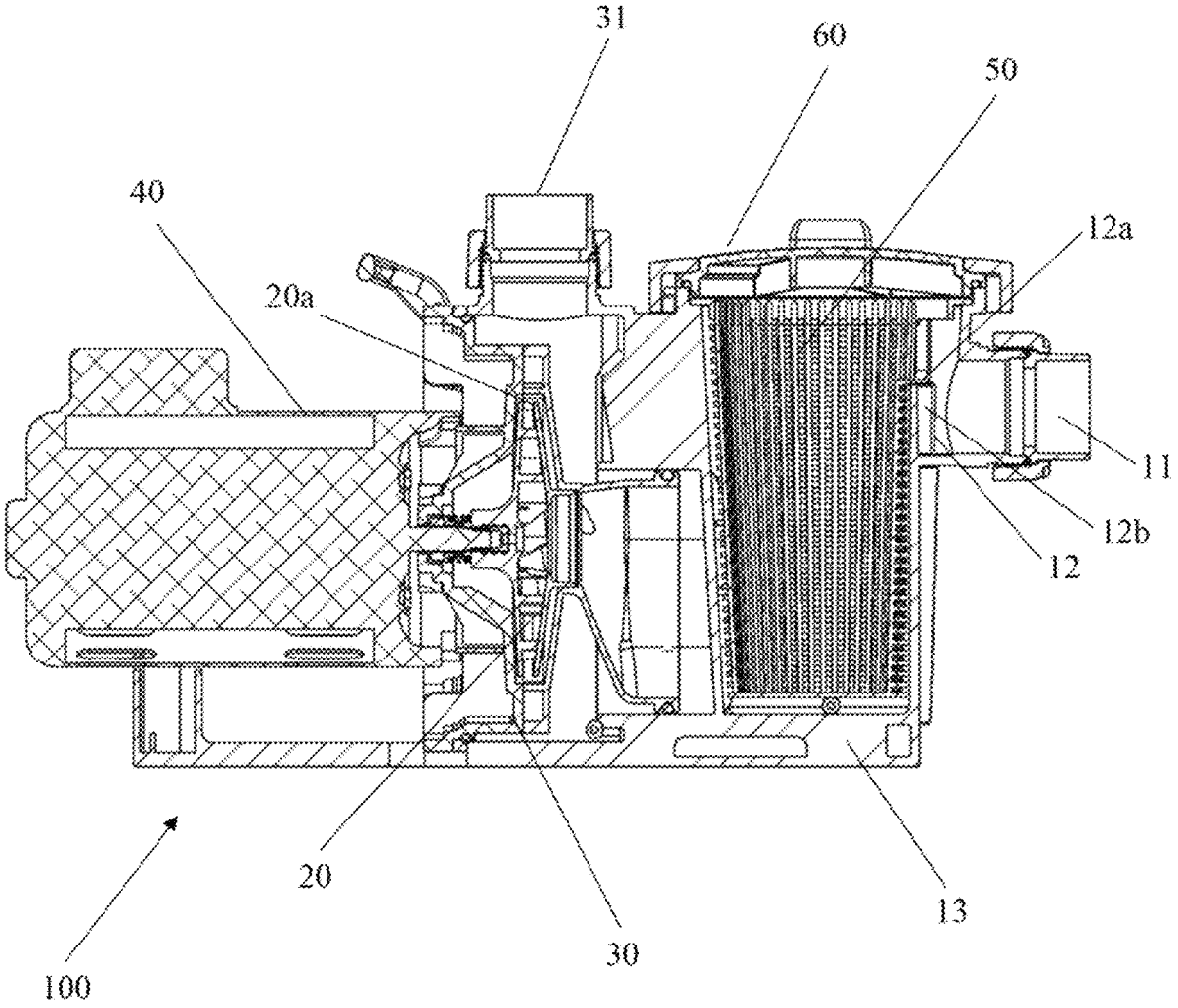
FIG. 3 is a cross sectional view of the swimming pool pump of the present invention.

The swimming pool pump 100 of the present invention comprises a strainer housing 10 having an inlet port 11 and a deflector 12, an impeller 20, an impeller shell 30 having an outlet port 31, a motor 40, a strainer 50, and a cover 60. FIG. 1 shows a perspective view of the swimming pool pump 100 of the present invention in its assembled state as it would be installed and ready for operation. FIG. 2 shows an exploded view of the swimming pool pump 100 of the present invention to depict in greater detail the various components that comprise the swimming pool pump 100. FIG. 3 shows a sectional view of the swimming pool pump 100 of the present invention.

Figure 4:
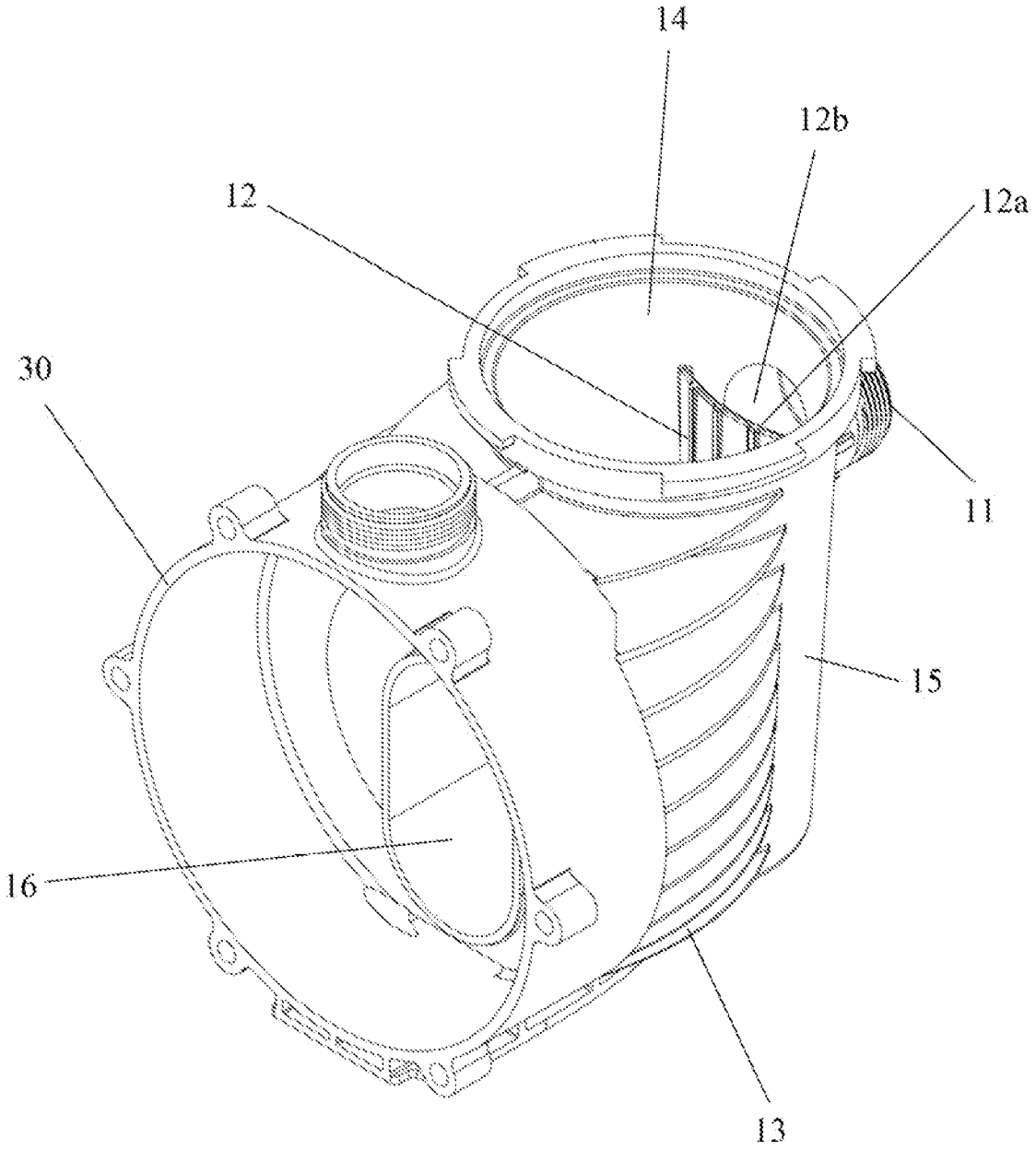
FIG. 4 is a perspective view of the strainer housing of the present invention.
Figure 5:
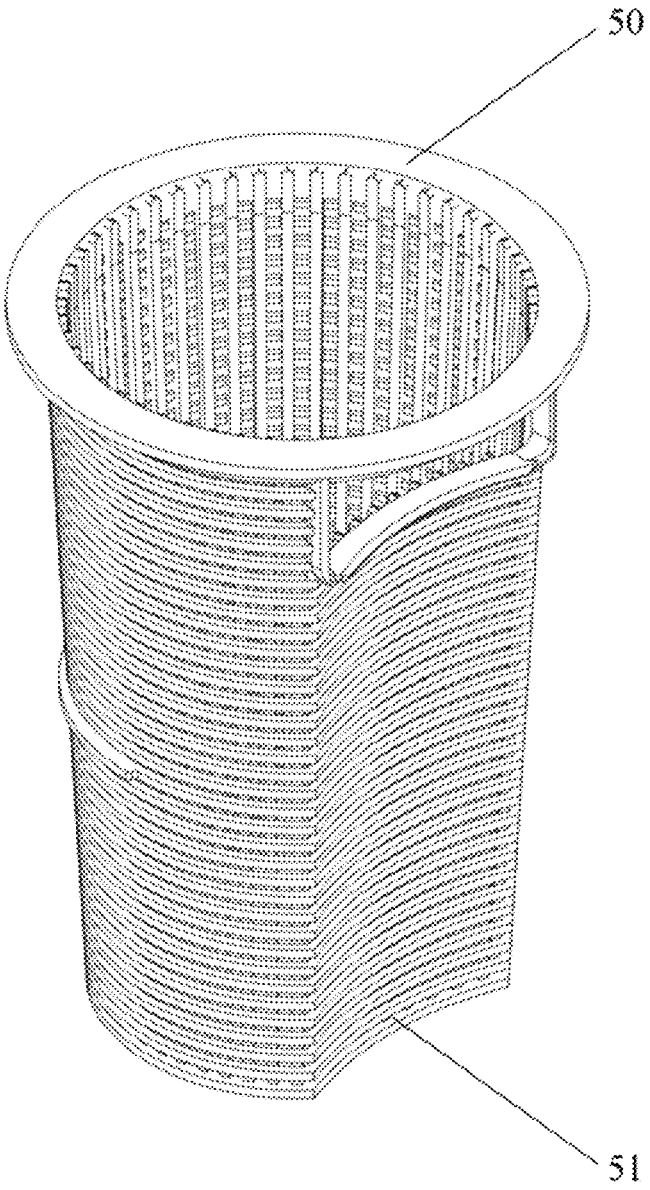
FIG. 5 is a perspective view of the strainer of the present invention.

As shown in FIG. 4, the strainer housing 10 has a base 13 and a top opening 14 through which a strainer 50 is inserted. A cover 60 is sealingly attached to the top of said strainer housing 10 to keep the swimming pool pump 100 of the present invention sealed and pressurized. Additionally, the strainer housing 10 has a sidewall 15 with an inlet port 11. Following said inlet port 11 and inline therewith is a deflector 12 that forms an additional cavity 12*b* and that is configured to redirect any water or liquid flowing through said inlet port 11. Water that flows into said strainer housing 10 through said inlet port 11 collides with said deflector 12 which redirects the flow upward, over said deflector 12, and down into said strainer housing 10. Thus, the deflector 12 disrupts the turbulent flow of water and redirects it with less turbulence. In addition, the deflector 12 and the additional cavity 12*b* entraps any large debris in the water before the water is allowed to flow down into the strainer housing 10 and the strainer 50.

The strainer 50 then entraps any other debris or contaminants that was not captured by the deflector 12 or the additional cavity 12*b*. Subsequently, once in the strainer 50, the water is sucked into the impeller shell 30 by the impeller 20 through a diffuser 16. However, in the swimming pool pump 100 of the present invention, the impeller shell 30 can be elongated or shortened so as to change its size and volume. As shown in FIG. 2, a spacer 35 can be added to make the impeller shell 30 larger. The spacer 35 can be any length to accommodate the desired size and volume of the impeller shell 30. The spacer 35 is attached to said impeller shell 30 with a radial seal that allows the pressurization of the said impeller shell 30. As the impeller shell 30 increases in size, the swimming pool pump 100 of the present invention is able to accommodate a larger impeller 20. The primary purpose of the larger impeller 20 is to increase the flow rate of the water being pumped out by the swimming pool pump 100 of the present invention.

It is well known in the art that running a swimming pool pump similar to that of the present invention without sufficient water in the impeller shell can lead to heat and friction related damage to the pump. This is a problem when the pump is first started or turned on. When a pump is first started, the water within the pump is settled and stagnant with the water level being at or around the bottom side of the inlet port. Thus, the water level tends to be below the uppermost point of the impeller, leaving a substantial portion of the top half of the impeller outside the water. As such, when the pump is turned on, the impeller begins to rotate with a substantial portion of its top half outside the water. This can lead to heat and friction related damage. It is understood that the swimming pool pumps of the prior art allow water to be sucked in through the inlet port to fill up the impeller shell with water quickly. Allowing the impeller shell to be filled with water upon the start of the pump is a process called priming. The more efficient the priming process, the less the heat and friction related damage incurred by the pump.

The larger impeller that can be accommodated by the swimming pool pump 100 of the present invention requires a more efficient priming process. The larger the impeller, the more critical it becomes that the priming process be efficient and effective.

The swimming pool pump 100 of the present invention addresses its need for improved priming by including said deflector 12 that allows the pump 100 to be primed quicker and more effectively than the prior art. The deflector 12 is located immediately after the inlet port 11 within the strainer housing 10 of the present invention. Thus, the deflector 12 serves as a buffer or blockage that blocks water within the strainer housing 10 from flowing back out through the inlet port 11 when the swimming pool pump 100 is turned off or not in operating mode. Furthermore, as shown in FIG. 3, the outlet port 31 is located above the inlet port 11 and above the impeller 20 so that water cannot flow out through the outlet port 31 when the swimming pool pump 100 of the present invention is in the off or not in operating mode. In essence, when the swimming pool pump 100 of the present invention is in the off or non-operating mode, the water within said pump 100 is settled and stagnant with the water level being at the topmost section 12*a* of the deflector 12 as opposed to the lowermost section of the inlet port as in the prior art. Furthermore, the topmost section 12*a* of the deflector 12 of the swimming pool pump 100 of the present invention is configured to be at or near the topmost section 20*a* of the impeller 20. Therefore, when the pump 100 is turned off, the water is settled and stagnant with the water level at or near the topmost section 20*a* of the impeller 20. Thus, when the pump 100 is turned on or activated, the impeller 20 is already substantially submerged in water. Having the impeller 20 substantially submerged in water at the start of the pump 100, substantially improves the priming process of the swimming pool pump 100 of the present invention and substantially reduces the heat and friction related damage that other pumps in the prior art experience.

Additionally, shape of the deflector 12 prevents the strainer 50 from being circular in shape as in the prior art. Instead, the shape of the strainer 50 must include a corresponding indentation 51 that accommodates the presence of the deflector 12 within the strainer hosing 10. Such indentation 51 not only accommodates the deflector 12, it also ensures that the strainer 50 is inserted into the strainer housing 10 is the proper alignment or position. This is unlike the strainers in the prior art which are circular in shape and the installer has to rely on some markings to align the strainer within the strainer housing.

It is understood that the described embodiments of the present invention are illustrative only, and that modifications thereof may occur to those skilled in the art. Accordingly, this invention is not to be regarded as limited to the embodiments disclosed, but to be limited only as defined by the appended claims herein.

What is claimed is:

1. A swimming pool pump comprising:

a strainer housing having an inlet port through which water flows and a deflector adjacent to said inlet port within said strainer housing that redirects said water to flow upward;

an impeller that is inserted into an impeller shell that is in fluid communication with said strainer housing and having an outlet port above said impeller;

a motor that rotates said impeller;

wherein said deflector forms a cavity into which said water flows before being redirected by said deflector;

wherein a lowermost section of said inlet port is below a topmost section of said impeller; and wherein a topmost section of said deflector is higher than a topmost section of said inlet port.

2. The swimming pool pump of claim 1 further comprising a strainer that is inserted into said strainer housing.

3. The swimming pool pump of claim 2 wherein said strainer includes an indentation to accommodate the presence of said deflector and aligns said strainer within said strainer housing.

4. The swimming pool pump of claim 1 further comprising a spacer that is removably attached to said impeller shell.

5. The swimming pool pump of claim 1 wherein said topmost section of said deflector is higher than said topmost section of said impeller.

6. The swimming pool pump of claim 1 wherein said strainer housing is sealably attached to said impeller shell and said motor is sealably attached to said impeller shell.

7. The swimming pool pump of claim 1 further comprising a cover that is sealably attached to said strainer housing.

8. A swimming pool pump comprising:

a strainer housing having a deflector adjacent to an inlet port wherein a top section of said deflector is higher than a top section of said inlet port and wherein said deflector forms a cavity into which water from said inlet port flows before flowing into said strainer housing;

an impeller shell comprising an outlet port above an impeller and a spacer that is removably attached to said impeller shell and that accommodates said impeller inserted therewithin;

wherein a lowermost section of said inlet port is below a topmost section of said impeller;

wherein said strainer housing is sealably attached to and in fluid communication with said impeller shell; and a motor that rotates said impeller and is sealably attached to said impeller shell.

9. The swimming pool pump of claim 8 further comprising a strainer that is inserted into said strainer housing.

10. The swimming pool pump of claim 9 wherein said strainer includes an indentation to accommodate the presence of said deflector and aligns said strainer within said strainer housing.

11. The swimming pool pump of claim 8 further comprising a cover that is sealably attached to said strainer housing.

* * * * *